US005346615A

United States Patent [19]

Savastano

[11] Patent Number: 5,346,615

[45] Date of Patent: Sep. 13, 1994

[54] PROCESS FOR DEASPHALTING AND DEMETALATING CRUDE PETROLEUM OR ITS FRACTIONS

[75] Inventor: Cesar Savastano, Zelo Buon Persico, Italy

[73] Assignee: Eniricerche S.p.A., Milan, Italy

[21] Appl. No.: 76,361

[22] Filed: May 27, 1993

Related U.S. Application Data

[63] Continuation of Ser. No. 709,492, Jun. 3, 1991, abandoned.

[30] Foreign Application Priority Data

Jun. 4, 1990 [IT] Italy ..... 20533 A/90
Nov. 23, 1990 [IT] Italy ..... 22177 A/90

[51] Int. Cl.[5] ..... C10C 3/02

[52] U.S. Cl. ..... 208/309; 208/39; 208/86

[58] Field of Search ..... 208/309, 311, 321, 322, 208/39, 86

[56] References Cited

U.S. PATENT DOCUMENTS 2,587,643 3/1952 Myers ..... 208/309
3,364,138 1/1968 Van Lookeren Campagne ..... 208/309
4,191,639 3/1980 Avdeh et al. ..... 208/309
4,324,651 4/1982 Rollmann et al. ..... 208/309
4,618,413 10/1986 Overfield ..... 208/251 R

*Primary Examiner*—R. Bruce Breneman
*Assistant Examiner*—Bekir L. Yildirim
*Attorney, Agent, or Firm*—Rogers & Wells

[57] ABSTRACT

A process is described for deasphalting and demetalating crude petroleum, or a fraction thereof, containing asphaltenes and metals, in which:

said crude petroleum or its fraction is brought in to contact with an organic carbonate, the operation being conducted in the homogeneous liquid phase, until a solid residue rich in asphaltenes and asphaltenic metals precipitates; and said solid residue is separated from the homogeneous liquid phase.

After separating, the solid, the homogeneous liquid phase can be cooled to separate an oil-rich refined liquid phase from the extracted liquid phase rich in organic carbonate. The separation of the extracted and refined liquid phases can also be achieved by adding a liquid solvent which is more polar than the carbonate, with or without cooling.

19 Claims, 1 Drawing Sheet

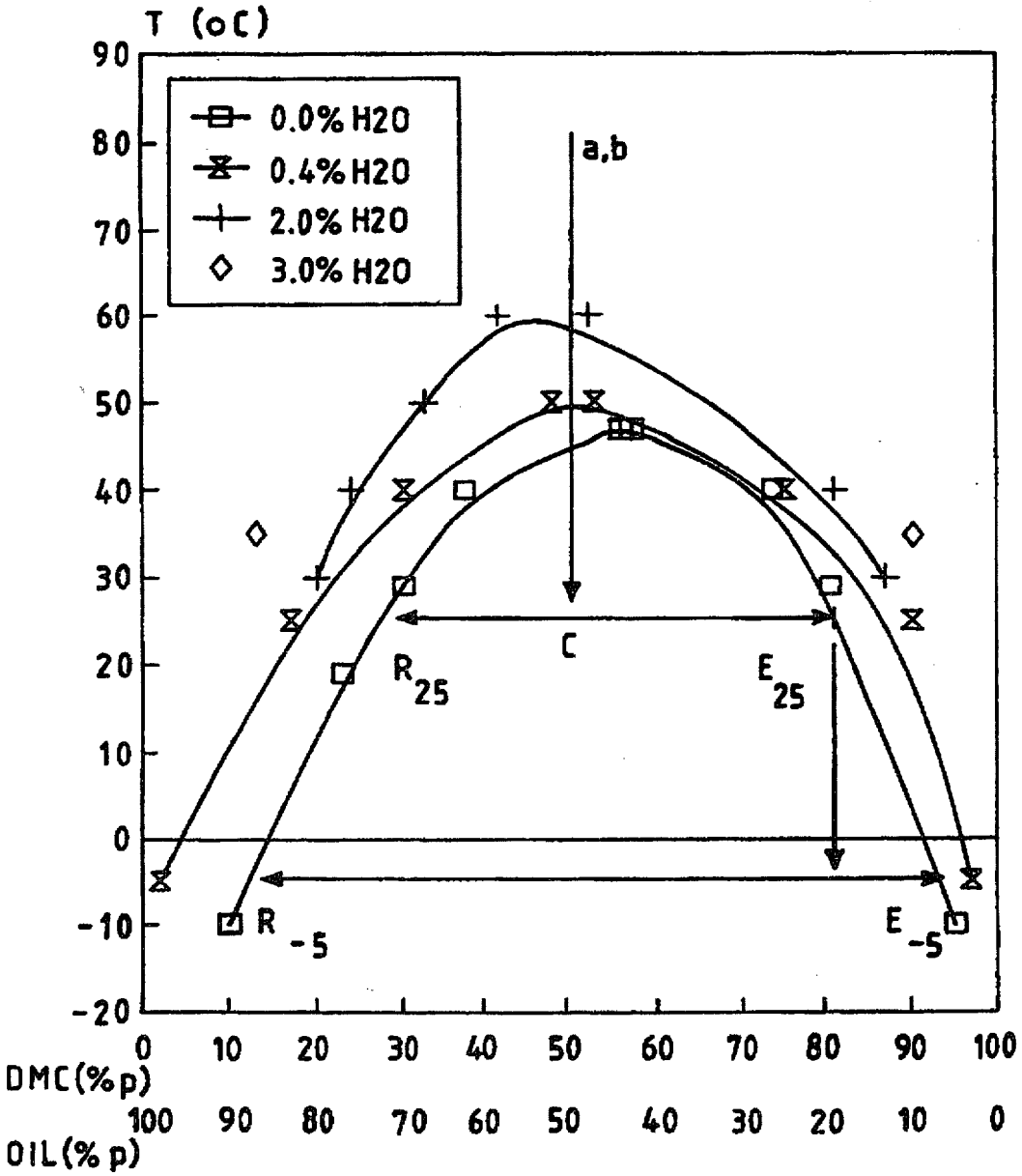
T (oC)
90
80
70
60
50
40
30
20
10
0
-10
-20
0.0% H2O
0.4% H2O
2.0% H2O
3.0% H2O
a,b
C
R25
E25
R -5
E -5
0 10 20 30 40 50 60 70 80 90 100
DMC(%p)
100 90 80 70 60 50 40 30 20 10 0
OIL(% p)

PROCESS FOR DEASPHALTING AND DEMETALATING CRUDE PETROLEUM OR ITS FRACTIONS

This application is a continuation of application Ser. No. 07/709,492, filed Jun. 3, 1991, now abandoned.

This invention relates to a process for deasphalting and demetallizing crude petroleum or its fractions containing asphaltenes and metals.

Vanadium and other metals, such as nickel and iron, are present in crude petroleum mainly in the form of porphyrinic and asphaltenic complexes. The metal content and the ratio of the two types of complexes depend essentially on the age of the crude petroleum and the severity of conditions during its formation. In some crudes, the vanadium content can reach 1200 ppm [J. M. Sugihara et al., J. Chem. Eng. Data 10, No. 2, April 1965 (190–194)], and the porphyrinic vanadium content can vary from about 20% to about 50% of the total vanadium [Fish and Komlenic, Anal. Chem., 56, (3), 1984 (510–517)].

The vanadium present in the crude has a deleterious effect on the refinery operations in that it represents a poison for catalysts used in catalytic cracking, hydrogenation and hydrodesulphurization. Vanadium present in fuel oil combustion catalyzes the oxidation of sulphur dioxide to sulphur trioxide, leading to corrosion and the formation of acid rain. In addition, metal porphyrins are relatively volatile and when the crude is vacuum-distilled, tend to pass into the heavier fractions of the distillate. Hence, traces of vanadium are usually found in vacuum gas oil.

In refinery operations it is unusal to use deasphalted oil as feed to the fluid catalytic cracking. Consequently, the oil is subjected to preliminary deasphalting as the asphaltenes tend to form coke and/or consume large quantities of hydrogen. The asphaltene removal also results in removal of the asphaltenic vanadium and nickel and of organic compounds with heteroatoms, especially nitrogen and sulphur. Industrial practice is specifically to deasphalt the crude distillation residues (resid) with propane or by the ROSE (residual oil solvent extraction) process, which uses n-butane or n-pentane. In this respect, reference should be made to H. N. Dunning and J. W. Moore, "Propane Removes Asphalts from Crudes", Petroleum Refiner, 36 (5), 247–250 (1957); J. A. Gearhart and L. Garwin, "ROSE Process Improves Resid Feed", Hydrocarbon Processing, May 1976, 125–128; and S. R. Nelson and R. G. Roodman, "The Energy Efficient Bottom of the Barrel Alternative", Chemical Engineering Progress, May 1985, 63–68. Specifically, deasphalting with propane is conducted in RDC (rotating disk contactor) columns at an overhead temperature of about 90° C., thus close to the propane critical temperature (about 97° C.), with a bottom temperature of about 40° C. and a propane/oil ratio of between about 5/1 and about 13/1. Under these conditions, a stream rich in light components and solvent is released as column overhead, and a heavy stream consisting essentially of asphalt and solvent as column bottom product. This second phase is rich in aromatics and contains nearly all the asphaltenes present in the feedstock. Both the exit streams are subjected to a series of isothermal flash evaporations at decreasing pressure until a propane/oil ratio of the order of 1/1 is obtained. Further lowering of the propane content requires stripping, usually with steam. The vaporized propane is condensed, compressed and recycled.

The ROSE process uses n-butane or n-pentane at high temperature and pressure, to produce two streams similar to those of the propane process. To recover the solvent, the temperature is raised beyond the solvent critical temperature to cause separation of a condensed oily phase and a gaseous solvent phase. The deasphalting efficiency in the process using propane is of the order of 75–83%, with an overall deasphalted oil recovery yield of the order of 70%. In the ROSE process, these values are 75–90% and 70–86%, respectively.

These processes are mostly costly and complicated, requiring very large solvent quantities in relation to the hydrocarbon feedstock to be treated, their efficiency and yield are not completely satisfactory, they produce asphaltic by-products and are unable to separate metals, such as porphyrinic vanadium and nickel, which are not eliminated with the asphaltene fraction.

To remedy these drawbacks, processes have been proposed in the art based on the use of solvents other than hydrocarbon solvents, in particular processes based on the use of polar solvents possibly used under supercritical conditions, but these have not shown significant development. U.S. Pat. No. 4,452,691 describes a process for transforming a high-boiling hydrocarbon feedstock into one with a lower boiling range which comprises contacting the initial feedstock with an oxygenated ether or alcoholic solvent to precipitate the asphaltenes from a liquid phase, this latter being fed without solvent separation to a zeolite catalyst. U.S. Pat. Nos. 4,618,413 and 4,643,821 describe the extraction of porphyrinic vanadium and nickel from an oil product by extracting with various solvents including ethylene carbonate, propylene carbonate and ethylene thiocarbonate.

In accordance with the present invention, it has now been found that an organic carbonate chosen from dialkyl carbonates and cyclic carbonates, under temperature conditions which allow mutual solubility with the crude petroleum or its fraction, produces rapid precipitation of an easily separable solid residue which is rich in asphaltenes, asphaltenic vanadium and nickel and heteroatomic sulphur and nitrogen organic compounds. It has also been found that when said homogeneous solution from which the precipitated solid has been removed is cooled to a temperature below mutual solubility temperature, and/or a liquid solvent more polar than the organic carbonate is added, it separates the homogeneous solution into a refined liquid oil phase and a denser extracted liquid phase rich in porphyrinic vanadium and nickel and in heteroatomic organic compounds. Finally, it has been found that this precipitation and phase separation take place under mild conditions, requiring only small solvent quantities, and result in a deasphalting efficiency and a deasphalted oil yield which are unexpectedly good. Thus, according to the present invention, an oil can be deasphalted with simultaneous removal of the porphyrinic vanadium and nickel, the asphaltenic vanadium and nickel and the heteroatomic compounds by operating in a simple and convenient manner, so overcoming or at least reducing the aforesaid drawbacks of the known art.

BRIEF DESCRIPTION OF THE DRAWING

The drawing is a graph showing the variation of the binary system composition as a function of temperature

DESCRIPTION OF PREFERRED EMBODIMENTS

In accordance therewith, the present invention provides a process for deasphalting and demetalating crude petroleum or a fraction thereof, containing asphaltenes and metals, the process being characterised by:

a) bringing said crude petroleum or its fraction, into contact with an organic carbonate chosen from dialkyl carbonates definable by the formula:

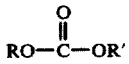

where R and R', which can be the same or different, represent a $C_1$–$C_3$ alkyl radical, and from cyclic carbonates definable by the formula:

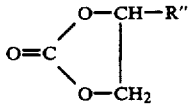

where R'' represents hydrogen or methyl; the operation being conducted in the homogeneous liquid phase, until a solid residue rich in asphaltenes and asphaltenic metals precipitates; and b) separating said solid residue from the homogeneous liquid phase.

According to one embodiment of the process of the present invention, the homogeneous liquid phase recovered in stage b) is cooled to induce the separation of an oil-rich refined liquid phase from an extracted liquid phase rich in organic carbonate. According to a further embodiment, a liquid solvent more polar than the organic carbonate is added with or without cooling, to said homogeneous liquid phase separated in stage b), to induce the separation of said refined and extracted liquid phases. In stage a) of the process of the present invention, a crude petroleum or its fraction and an organic carbonate are brought into contact at a temperature equal to or greater than the mutual solubility temperature. Organic carbonates suitable for this purpose are dimethyl carbonate, diethyl carbonate, dipropyl carbonate, diisopropyl carbonate, ethylene carbonate and propylene carbonate. Mixed dialkyl carbonates can also be used, such as methyl ethyl carbonate. The preferred organic carbonates for this purpose are dimethyl carbonate and diethyl carbonate. Of the two, dimethyl carbonate is more preferred. Stage a) of the process of the present invention is conveniently conducted with a weight ratio of organic carbonate to crude of between 0.5/1 and 4/1. It has been found that if a lower ratio than 0.5/1 is used, with the other stated conditions being the same, the deasphalting efficiency is unacceptably low, whereas with a ratio exceeding 4/1, a tacky solid precipitate is obtained which does not sediment and is difficult to separate. The preferred weight ratio of organic carbonate to crude is between 1.5/1 and 2.5/1, the optimum value being of the order of 2/1.

The homogeneous liquid phase is maintained at a temperature equal to or greater than the mutual solubility temperature.

In particular, if dimethyl carbonate is used with a weight ratio of dimethyl carbonate to crude of between 1.5/1 and 2.5/1, mutual solubility conditions (formation of a homogeneous liquid phase) are obtained above about 45° C., depending on the ratio itself. If diethyl carbonate is used, mutual solubility is already obtained at ambient temperature (20°–25° C.). With propylene carbonate, a homogeneous liquid phase is obtained at a temperature of the order of 150° C., which phase-separates rapidly on cooling to a temperature below about 120° C. With ethylene carbonate a homogeneous liquid phase is obtained at a temperature exceeding 150° C.

Consequently, the temperature at which precipitation occurs can generally vary from ambient temperature (20°–25° C.) to about 150° C. or more, depending on the particular organic carbonate used, and if necessary employing greater than atmospheric pressure to maintain the system in the liquid phase. When the organic carbonate is dimethyl carbonate, the operating temperature is preferably within the range of 60°–90° C., with an optimum preferably value of the order of 80° C. When the organic carbonate is diethyl carbonate, the operating temperature is ambient or close to ambient.

In all cases, a solid residue rich in asphaltenes, asphaltenic vanadium and nickel and heteroatomic compounds rapidly separates from the homogeneous liquid phase. It should be noted that when operating below the mutual solubility temperature the deasphalting efficiency is undesirably low. The contact time for precipitation can vary generally from a few minutes, for example 2 minutes, to several hours, for example up to 6 hours. Generally, substantially complete precipitation is obtained in a time of between a few minutes (for example 1–2 minutes) and 1 hour. In stage b) of the process of the present invention, the solid precipitated in stage a) is separated from the homogeneous liquid phase. It has been found in practice that when operating under the aforedescribed conditions, the precipitated solid sediments easily because of the density difference between the solid and the homogeneous liquid phase and the low viscosity of the liquid phase because of the solvent, possibly combined with the effect of temperature. In the practical implementation of stage b) of the process, any known method for separating a solid from a liquid can be used, such as gravimetric sedimentation, centrifuging, filtration or hydrocyclone treatment. The temperature at which the separation takes place must be such as to maintain the liquid phase homogeneous. Consequently, the temperature used must be within the range indicated for stage a).

According to the process of the present invention, after separation of the solid, the homogeneous liquid phase obtained in stage b) is separated [stage c)] into an extracted liquid phase and a refined liquid phase. This can be achieved by two different methods.

In one of these methods, said homogeneous liquid phase is cooled [stage c')] to a temperature below the mutual solubility temperature in order to separate an oil-rich refined liquid phase from an extracted liquid phase which is rich in organic carbonate. In the other method, a liquid solvent more polar than the organic carbonate is added, with or without cooling [stage c'')], to the homogeneous liquid phase of stage b), in order to separate said refined and extracted liquid phases. A suitable liquid solvent more polar than the carbonate is water or a lower aliphatic alcohol, preferably methanol, or their mixtures. The quantity of this solvent added can generally vary from 0.1 to 10% by weight of the organic carbonate. In the case of water, these quantities also comprise the water which may be present in a small quantity in the crude. Preferably, a solvent quantity of the order of 2–3% by weight of the organic carbonate is added, preferably with simultaneous cooling in order to induce separation of the extracted and refined liquid phases. The temperature at which this phase separation occurs varies according to the organic carbonate used and the presence or absence of the liquid solvent more polar than the carbonate. In general, the phase separation temperature can vary from about −10° C. to about 120° C. However, when using dimethyl carbonate the phase separation temperature is preferably of the order of 25°–35° C. independant of whether the liquid solvent more polar than dimethyl carbonate is present or not. When using diethyl carbonate, the phase separation is preferably effected at ambient or close to ambient temperature, by adding said more polar liquid solvent, especially methanol. In all cases, the phase separation is rapid and produces a well-separated refined liquid phase and extracted liquid phase the composition of which, other conditions being equal, depends on the phase separation temperature. To this end, reference should be made to the accompanying figure which shows the variation in solubility, determined experimentally, of a binary system formed from dimethyl carbonate (DMC) and Egyptian Belaym crude dried and free of asphaltenes (curve-□). In the diagram, the horizontal axis represents the composition of the binary system and the vertical axis represents temperature in °C. In that part of the diagram above the curve, there is complete miscibility and the system is in the homogeneous liquid phase, with a complete mutual solubility temperature of about 47° C. The precipitation of the solid in stage a) of the process is effected under these conditions of homogeneity. In that part of the diagram below the curve there are two liquid phases in equilibrium; specifically, a refined liquid phase (to the left) and an extracted liquid phase (to the right). This situation occurs when the homogeneous liquid phase is cooled, after solid separation, to a temperature below the mutual solubility temperature, at which the system separates into two liquid phases, namely an oil-rich refined liquid phase and a solvent-rich extracted liquid phase. For example, when a system formed from 50 wt % of oil and 50 wt % of dimethyl carbonate is cooled to about 25° C., as shown in the Figure, it separates typically into a refined liquid phase with about 73 wt % of oil, the remainder being essentially dimethyl carbonate. Under these conditions, the corresponding extracted liquid phase contains about 83 wt % of dimethyl carbonate, the remainder being essentially oil. It is also possible to choose a phase separation temperature below 25° C., for example down to −10° C., to obtain a refined liquid phase still more rich in oil (about 90% by weight) and an extracted liquid phase still more rich in dimethyl carbonate (about 95% by weight). Alternatively, the refined liquid phase and extracted liquid phase obtained at 25° C. can be individually subjected to further cooling. For example, further cooling the extracted liquid phase obtained at 25° C. to about −5° C. results in separation of a second extract formed substantially of only dimethyl carbonate, and a second refined phase formed substantially of only oil, as shown graphically in the Figure.

FIG. 1 also shows the variation for the dimethyl carbonate (DMC) system and Belaym crude freed of asphaltenes, to which a water quantity of 0.4 wt % (curve-⧖), 2 wt % (curve-+) and 3 wt % (curve-◇), based on the weight of dimethyl carbonate which has been added. It can be seen that the addition of water raises the temperature of complete solubility of the system and that this system containing water separates to produce an extracted phase richer in dimethyl carbonate and a refined phase richer in oil, according to the water content.

It has been found in practice that operating as described heretofore, the porphyrinic vanadium and nickel initially present in the crude remain to a large extent dissolved in the extracted liquid phase, the refined liquid phase being consequently depleted of both porphyrinic and asphaltenic vanadium and nickel. It has also been found that the oil present in the extracted phase is lighter (average molecular weight typically about 66% of the feedstock value), whereas the average molecular weight of the oil in the refined phase is practically unchanged from the initial value. The solid separated in stage b) of the process is rich in asphaltenic vanadium and nickel and in organic compounds with sulphur and nitrogen heteroatoms. Specifically, the average molecular weight of the asphaltenic precipitate is typically about 2100, i.e. of the order of magnitude of the average molecular weight of a heavy asphalt and close to the typical value for asphaltenes (2200–2300). Operating according to the present invention, it is therefore possible to obtain the fractionation of the components initially present in the crude, with a concentration of the lighter components in the extracted phase. In addition this phenomenon of fractionation at the various temperatures, deriving in fact from the different affinity of the polar and non-polar compounds for the organic carbonate solvent at the various temperatures, can be governed within certain limits on the basis of the phase separation temperature and/or by repeated phase separation.

Finally, the extracted and refined liquid phases can be subjected to usual treatment for recovering their constituents.

Any crude or a fraction thereof can be treated by the process of the present invention, such as crudes reduced by atmospheric or reduced pressure distillation containing asphaltenes and having a density generally of between about 10° and about 45° API. The asphaltene content of such crudes can reach values of the order of 20% by weight. The process is preferably carried out on a crude or fraction with an initial boiling point of about 20°–40° C. higher than the boiling point of the organic carbonate used. In the case of heavier crudes or distillation residues which are difficult to treat under the conditions of this process, such crudes or residues can be diluted with a hydrocarbon component before treatment with the organic carbonate. Hydrocarbon components suitable for this purpose can be chosen from those which do not significantly modify the natural state of the oil-asphaltene dispersion, such as $C_{10}$–$C_{20}$ paraffin cuts, gas oils and kerosenes of the type usually used for motor traction. The quantity of the chosen hydrocarbon component is such as to provide sufficient fluidity for conducting the operations of the process according to the present invention. At the end of the process the added hydrocarbon component is recovered from the refined and extracted liquid phases by normal operations known in the art, such as flash evaporation.

The process of the present invention is simple and convenient. In particular, it can be conducted at moderate temperature, without applying overpressure and with a low ratio of organic carbonate to crude or crude fraction.

In addition, the process provides high deasphalting efficiency generally in the range of 85–99%, these values being higher than those of the aforesaid commercial processes. The total deasphalted oil yield is generally greater than 90%, this value being equal to or better than known processes.

The following experimental examples are provided to better illustrate the present invention.

EXAMPLE 1

In this example an Egyptian Belaym crude (land/offshore blend) of the following characteristics is subjected to deasphalting:

| | |
|---|---|
| density | 27.0° API |
| specific gravity | 0.888 g/ml (20° C.) |
| kinematic viscosity | 57.13 cS (20° C.)<br>23.86 cS (37.8° C.) |
| K UOP | 11.92 |
| asphaltenes (insoluble in n-heptane) | 7.0% by weight |
| sulphur content | 2.31% by weight |
| nitrogen content | 5900 ppm |
| vanadium content | 69 ppm |
| nickel content | 60 ppm |
| moisture content | about 0.4% by weight |

208.2 g of dimethyl carbonate and 98.9 g of crude of the abovesaid characteristics are fed into a flask fitted with a stirrer. The mixture is heated to 80° C. and kept stirring at this temperature for 1 hour to obtain in the flask a homogeneous liquid phase and a solid precipitate suspended in said liquid phase. The suspension obtained in this manner is filtered under hot conditions (about 80° C.) through a Whatman filter paper with vacuum applied by a water pump, to collect 14.5 g of a solid residue. A cold trap is connected between the filtrate collection vessel and the vacuum pump to condense the dimethyl carbonate and other light compounds which vaporize during filtration. After the filtration, the contents of the cold trap are added to the filtrate, which is then placed in a separator funnel and left to cool at ambient temperature (about 25° C.). At this temperature, the liquid separates into two phases, namely an upper (refined) oil phase of 83.5 g and a lower denser (extracted) phase of 209 g. The separated solid residue consists of 6.4 g (44% by weight) of asphaltenes and 8.1 g (56% by weight) of a retained refined phase consisting of about 6.4 g of deasphalted oil and 1.4 g of dimethyl carbonate.

The refined liquid phase consists of 69.2 g of oil (82.8% by weight), 13.8 g of dimethyl carbonate (16.5% by weight) and 0.5 g of asphaltenes (0.6% by weight).

The extracted liquid phase consists of 16.7 g of oil (8% by weight) and 192 g of dimethyl carbonate (92% by weight).

The crude deasphalting efficiency is therefore 92.4%. The total oil recovery yield is 87% by weight on the crude, with 70% recovery in the refined phase and 17% recovery in the extracted phase. The total deasphalted oil yield, evaluated on the oil content of the crude, is 93.4% by weight.

Table 1 sumarizes the characteristics of the initial crude (G), the solid residue (RS), the refined liquid phase (LR) and the extracted liquid phase (LE).

TABLE 1

| Characteristics | G | RS | LR | LE |
|---|---|---|---|---|
| asphaltenes (% weight) | 7.0 | 44 | 0.63 | 0 |
| vanadium (ppm) | 69 | nd | 28 | 2.2 |
| nickel (ppm) | 60 | nd | 22 | 0.8 |
| sulphur (% weight) | 2.31 | nd | 1.02 | 0.26 |
| nitrogen (ppm) | 5900 | nd | 2100 | 322 |

nd = not determined

The asphaltene content of the crude and the various separated phases is determined gravimetrically in accordance with ASTM D-2007 modified in accordance with IP-143, operating with a weight ratio of 10 parts of n-heptane per part of sample, with asphaltene precipitation in 2 hours under reflux conditions.

The vanadium and nickel content is evaluated by atomic absorption analysis on samples previously subjected to acid digestion. The vanadium content is confirmed by vanadium (IV) electron spin resonance spectroscopy.

The sulphur content is evaluated by X-ray fluorescence. The nitrogen content is evaluated by the usual Kjeldahl method. The carbon/hydrogen atomic ratio is evaluated by elemental analysis under oxygen flow.

From the data given in Table 1, it can be seen that the efficiency of vanadium removal from the crude is 59% (52.6% in the solid precipitate and 6.4% in the extracted liquid phase). The efficiency of nickel removal is 60% (57.3% in the solid precipitate and 2.7% in the extracted liquid phase). The sulphur removal is about 56% (22.5% being the extraction contribution) and the nitrogen removal is 64% (11% being the extraction contribution). The C/H weight ratio in the solid residue (8.77/1) is clearly higher than that of the initial crude (6.97/1). From elemental analysis and weight balances, it can be confirmed that oxygen is not incorporated preferentially into the refined oil. No dimethyl carbonate decomposition was noted during the treatment.

When the extracted liquid phase, obtained as described, is cooled from 25° C., to −5° C., a further oil phase separates in a quantity of 6% by weight, based on the weight of the extracted liquid phase.

EXAMPLE 2

A series of tests are conducted by bringing the Belaym crude of Example 1 into contact at different temperatures with dimethyl carbonate in a weight ratio of 1:1. In each case, stirring is maintained for 1 hour.

After stirring, the residual solid is separated by filtration at the precipitation temperature. The filtered liquid phase is cooled to 25° C. (except for the first test, which is conducted at this temperature) and an extracted liquid phase and refined liquid phase separate. Tests 1 to 4 are outside the scope of the present invention in that at the precipitation temperatures used there is incomplete miscibility between the crude and the dimethyl carbonate. In tests 5 to 8, complete miscibility between the crude and the dimethyl carbonate in the precipitation stage is obtained, these tests therefore falling within the scope of the invention.

Table 2 shows for each test the temperature (°C.) during the precipitation stage, the weight percentage of residual asphaltenes in the refined liquid phase (% A-R) and the deasphalting efficiency (% Eff-D) expressed as the weight percentage of precipitated asphaltenes on the asphaltene content of the crude.

TABLE 2

| Test No. | Temp (°C.) | % A-R | % Eff-D |
|---|---|---|---|
| 1 | 25 | 7.1 | 0 |
| 2 | 30 | 5.4 | 24 |
| 3 | 40 | 5.7 | 20 |
| 4 | 50 | 5.2 | 26 |
| 5 | 60 | 4.1 | 41 |
| 6 | 70 | 3.9 | 44 |
| 7 | 80 | 3.9 | 44 |
| 8 | 90 | 4.1 | 41 |

EXAMPLE 3

A series of tests are conducted by bringing dimethyl carbonate into contact with the Belaym crude of Example 1 at different mutual weight ratios, stirring for 1 hour at 80° C., separating the residual solid at this temperature by filtration and, finally, cooling the filtrate to 25° C. to separate an extracted liquid phase from a refined liquid phase. Tests 1 to 4 are conducted in accordance with the invention. Tests 5 and 6 are comparison tests in that at these dimethyl carbonate/crude weight ratios the precipitated solid is tacky and unfilterable.

The test results are summarized in Table 3, which shows the weight ratio (Rapp) of dimethyl carbonate to crude during the extraction stage, the weight percentage of residual asphaltenes in the refined liquid phase (% A-R) and the deasphalting efficiency (% Eff-D) expressed as the weight percentage of precipitated asphaltenes on the asphaltene content of the crude.

TABLE 3

| Test No. | Rapp | % A-R | % Eff-D |
|---|---|---|---|
| 1 | 1/5 | 5.9 | 15 |
| 2 | 1/2 | 6.1 | 13 |
| 3 | 1/1 | 3.9 | 44 |
| 4 | 2/1 | 0.9 | 87 |
| 5 | 5/1 | precipitate not filterable | |
| 6 | 10/1 | precipitate not filterable | |

EXAMPLE 4

A series of tests are conducted by bringing the Belaym crude of Example 1 into contact for different times with dimethyl carbonate in a weight ratio of about ½, stirring at 80° C., separating the residual solid at this temperature by filtration and, finally cooling the filtrate to separate an extracted liquid phase from a refined liquid phase.

Table 4 summarizes the results of tests 1 to 5, showing the contact time in hours between the crude and the dimethyl carbonate at 80° C., the weight percentage of residual asphaltenes in the refined liquid phase (%A-R) and the deasphalting efficiency (%Eff-D) expressed as the weight percentage of precipitated asphaltenes on the asphaltene content of the crude.

TABLE 4

| Test No. | Time (hours) | % A-R | % Eff-D |
|---|---|---|---|
| 1 | 0.5 | 0.4 | 93 |
| 2 | 1.0 | 0.7 | 88 |
| 3 | 2.0 | 0.5 | 92 |
| 4 | 4.5 | 0.6 | 90 |
| 5 | 6.0 | 0.6 | 90 |

EXAMPLE 5

A Rospo di Mare crude (11.8° API) with an asphaltene content of 20.3% by weight is diluted with gas oil of the type used commercially for motor traction, the mixture obtained being brought into contact with dimethyl carbonate, stirring for 1 hour at 80° C. The dimethyl carbonate/crude/gas oil weight ratio is 2.2:1:1. At 80° C. a homogeneous liquid phase exists, and, a residual solid precipitates which is filtered off at approximately the precipitation temperature. The filtrate separates at 25° C. into a refined liquid phase and an extracted liquid phase. In the refined liquid phase a residual asphaltene quantity of 4.7% by weight is found (value already corrected for the dilution with gas oil). The deasphalting efficiency is thus 76% evaluated on the asphaltene content of the crude.

For comparison, three tests of asphaltene extraction from the crude are conducted operating under the aforesaid conditions but without dimethyl carbonate, and with a ratio of gas oil to crude of 0.6:1, 1:1 and 3:1 respectively. In the three tests a refined phase is obtained with an average asphaltene content of 19.3% by weight and an average crude deasphalting efficiency of 4.9%.

EXAMPLE 6

27.75 g of dimethyl carbonate are added to 13.35 g of the Belaym crude of Example 1 (dimethyl carbonate/oil weight ratio 2.08/1) and the mixture kept stirring for 30 minutes at 80° C. The solution obtained is adjusted to 60° C. and maintained at this temperature for 20 minutes. The asphaltene solid is separated by filtration, 0.60 g of deionized water (2.1% by weight on the dimethyl carbonate) are added to the filtrate and the mixture cooled to 35° C. while stirring. When the stirring is interrupted, an extracted liquid phase rich in dimethyl carbonate (density 1.039 g/ml) and an oil-rich refined phase (density 0.759 g/ml) quickly separate. These values and the composition of the phases are comparable with those of the anhydrous system, but separated at 20° C. A residual asphaltene content of 0.3% by weight is determined in the refined phase. The deasphalting efficiency is thus 93%.

When the test is repeated heating initially to 60° C. instead of 80° C. The deasphalting efficiency is 47.1%.

EXAMPLE 7

A series of tests are conducted by bringing diethyl carbonate into contact with the Belaym crude of Example 1 at different mutual weight ratios, stirring for 10 minutes at ambient temperature (20°-25° C.), allowing the solid to sediment for 20 minutes, and separating the solid by centrifuging at 2500 rpm for 5 minutes. The test results are summarized in Table 5, which shows the weight ratio (Rapp) of diethyl carbonate to crude during the extraction stage, and the deasphalting efficiency (%Eff-D) expressed as the weight percentage of precipitated asphaltenes on the asphaltene content of the crude.

TABLE 5

| Test No. | Rapp | % Eff-D |
|---|---|---|
| 1 | 1/1 | 44.1 |
| 2 | 1.5/1 | 74.4 |
| 3 | 2/1 | 100 |

EXAMPLE 8

In this example, an RA370+Belaym (RA=atmospheric residue) is treated with dimethyl carbonate, stirring at 80° C. for 30 minutes, filtering the precipitate, and phase-separating at ambient temperature to obtain a refined liquid phase and an extracted liquid phase. RA370+Belaym has the following characteristics: asphaltene content 8.8% by weight; density 15/4° C. 0.9865 g/ml; kinematic viscosity at 50° C.: 2968 cSt, at 100° C.: 117.5 cSt; yield on crude feed to atmospheric distillation about 60% by weight. The test results are summarized in Table 6, which shows the weight ratio (Rapp) of dimethyl carbonate to the RA370+Belaym during the extraction stage, and the deasphalting efficiency (%Eff-D) expressed as the weight percentage of precipitated asphaltenes on the asphaltene content of the crude.

TABLE 6

| Test No. | Rapp | % Eff-D |
|---|---|---|
| 1 | 1/1 | 35.2 |
| 2 | 2/1 | 64.0 |
| 3 | 4/1 | 86.5 |

I claim:

1. A process for deasphalting and demetallizing crude petroleum, or a fraction thereof, containing asphaltenes and metals, said process consisting essentially of a) contacting said crude or its fraction with a deasphalting agent consisting of an organic carbonate selected from the group consisting of dialkyl carbonates definable by the formula:

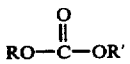

where R and R', which can be the same or different, represent a C1–C3 alkyl radical, and cyclic carbonates definable by the formula:

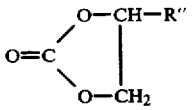

where R'' represents hydrogen or methyl to form a crude/carbonate combination;

b) raising the temperature of the crude/carbonate combination to form a homogeneous liquid phase;

c) maintaining the homogeneous liquid phase for a time sufficient to form a precipitate comprised of a solid residue rich in asphaltenes and asphaltenic metals;

d) separating said solid residue from the homogeneous liquid phase under conditions which maintain the homogeneous liquid phase; and e) cooling the homogeneous liquid phase recovered in step d) to induce separation of the homogeneous liquid phase into a refined liquid phase and an extracted liquid phase.

2. A process as claimed in claim 1, wherein the organic carbonate is selected from the group consisting of dimethyl carbonate, diethyl carbonate, dipropyl carbonate, diisopropyl carbonate, ethylene carbonate, propylene carbonate and mixtures of more than one of the foregoing.

3. A process as claimed in claim 2, wherein said organic carbonate is selected from the group consisting of dimethyl carbonate and diethyl carbonate.

4. A process as claimed in claim 3, wherein said organic carbonate is dimethyl carbonate.

5. A process as claimed in claim 1, wherein step a) is conducted with a weight ratio of organic carbonate to crude of between 0.5/1 and 4/1.

6. A process as claimed in claim 5, wherein step a) is conducted with a weight ratio of organic carbonate to crude of between 1.5/1 and 2.5/.

7. A process as claimed in claim 6, wherein step a) is conducted with a weight ratio of organic carbonate to crude of about 2/1 .

8. A process as claimed in claim 1, wherein step a) is conducted at a temperature equal to or greater than the mutual solubility temperature of the crude/carbonate combination and for a time of between about 2 minutes and about 6 hours.

9. A process as claimed in claim 8, wherein step a) is conducted at a temperature of at least 20° C.

10. A process as claimed in claim 9, wherein step a) is conducted at a temperature of between 20° C. and 150° C.

11. A process as claimed in claim 8, wherein step a) uses dimethyl carbonate and is conducted at a temperature of between 60° and 90° C.

12. A process as claimed in claim 11, wherein step a) is conducted at a temperature of about 80° C.

13. A process as claimed in claim 8, wherein step a) uses diethyl carbonate and is conducted at or close to ambient temperature (20°–25° C.).

14. A process as claimed in claim 8, wherein step a) further comprises applying an overpressure.

15. A process as claimed in claim 8, wherein step a) is conducted for a time of between about 2 minutes and 1 hour.

16. A process as claimed in claim 1, wherein in step d) the precipitated solid is separated by gravimetric sedimentation, centrifuging, filtration or by treatment in hydrocyclones at a temperature equal or close to that of step a).

17. A process as claimed in claim 1, wherein the phase separation is effected by cooling to a temperature of between −10° C. and 35° C.

18. A process as claimed in claim 1, wherein dimethyl carbonate comprises the organic carbonate and said phase separation is effected by cooling to a temperature of between 25° and 35° C.

19. A process as claimed in claim 1, wherein prior to step a) the crude or its fraction is diluted with a liquid hydrocarbon fraction selected from the group consisting of C10–C20 paraffin cuts, gas oils and kerosenes of the type used for motor traction.

* * * * *